US005346107A

United States Patent [19]

Bouix et al.

[11] Patent Number: 5,346,107

[45] Date of Patent: Sep. 13, 1994

[54] DISPENSING DEVICE FOR A RECEPTACLE CONTAINING A PRODUCT OF LIQUID TO PASTY CONSISTENCY

[75] Inventors: Hervé Bouix, Marly le Roi; Vincent de Laforcade, Clamart, both of France

[73] Assignee: L'Oreal, Paris, France

[21] Appl. No.: 982,551

[22] Filed: Nov. 27, 1992

[30] Foreign Application Priority Data

Nov. 29, 1991 [FR] France ..... 91 14775

[51] Int. Cl.[5] ..... B65D 25/40

[52] U.S. Cl. ..... 222/490; 222/494; 222/558

[58] Field of Search ..... 222/490, 494, 558

[56] References Cited

U.S. PATENT DOCUMENTS

| | | | |
|---|---|---|---|
| 1,828,224 | 10/1931 | Freeman | 222/558 X |
| 1,891,280 | 12/1932 | Hazlett et al. | 222/558 X |
| 1,922,999 | 8/1933 | Williams | 222/558 X |
| 2,123,694 | 7/1938 | Denbow | 222/558 X |
| 4,804,098 | 2/1989 | Montgomery | 222/558 X |
| 5,005,737 | 4/1991 | Rohr | 222/490 X |

FOREIGN PATENT DOCUMENTS

| | | | |
|---|---|---|---|
| 5169 | 5/1879 | Fed. Rep. of Germany . | |
| 349870 | 7/1905 | France . | |
| 1541166 | 8/1968 | France . | |
| 97150 | 10/1960 | Norway | 222/558 |
| 276881 | 7/1951 | Switzerland . | |

*Primary Examiner*—Andres Kashnikow
*Assistant Examiner*—Joseph A. Kaufman
*Attorney, Agent, or Firm*—Cushman, Darby & Cushman

[57] ABSTRACT

The dispensing device includes a sealing capsule fitted with a dispensing opening (3), the capsule including a clamp (6) having two arms (7) linked by a crosspiece (9), one zone of which serves to close the opening (3), the ends of the arms furthest away from the crosspiece being fitted with articulation parts (A) on a fixed part of the receptacle (1); these articulation parts (A) are designed to allow displacement of the clamp (6) in an axial direction (X—X) in order to distance the crosspiece (9) of the opening (3). The device includes a cam system (c), set in between the arms (7) of the clamp (6) and a fixed part of the receptacle, intended to cause the displacement of the clamp (6) in an axial direction (X—X); the articulation parts (A) of the clamp (6) include a non-circular transversal sectioned axis (16) on each arm, which works together with a window (17) in such a way that, whatever the angle of the axis, the axis (16) and the internal face of the window (17) are sufficiently close to prevent any movement of the clamp in relation to the receptacle, whilst causing the aforementioned displacement in an axial direction.

11 Claims, 3 Drawing Sheets

DISPENSING DEVICE FOR A RECEPTACLE CONTAINING A PRODUCT OF LIQUID TO PASTY CONSISTENCY

FIELD OF THE INVENTION

The invention pertains to a dispensing device, for a receptacle containing a product of liquid to pasty consistency, of the type which includes a sealing capsule which has a dispensing opening, the said capsule possessing a means of closing more or less in the form of a clamp which has two arms linked by a crosspiece, a part of which serves to close the said opening, the far ends of the said arms bearing means of articulation on a section fixed to the receptacle, these means of articulation being designed to allow for displacement of the clamp following the axial direction of the receptacle in order to move the crosspiece on the said opening, the whole being such that rotating the clamp will cause displacement of the crosspiece following a trajectory more or less at a tangent to the said opening.

DESCRIPTION OF THE PRIOR ART

In such a device, the possible displacement of the clamp following the axial direction of the receptacle allows, by moving the crosspiece away from the opening, for avoidance of parasitic friction of the crosspiece against the opening, and/or of disengaging a closing device from the opening which could pass through it in a longitudinal direction.

FR-A-1 541 166 shows, especially in FIG. 5 to 8, a closing device of this type which uses springs, during the articulation process, which allow for the displacement of the rotation axis due to the traction exerted by the user.

This device is relatively complicated, notably from the point of view of assembly, due to the presence of the springs. Furthermore, it is relatively fragile to use, because the springs could leave their housing if not handled correctly. Moreover, such a device demands that the user effects a double movement, including an initial traction movement to the clamp, followed by rotation.

U.S. Pat. No. 1,828,224 shows a dispensing device of the type in question, which also includes cams, set between the arms of the clamp and a fixed section of the receptacle, which, on commencement of rotation of the clamp, from its closed position, will cause the aforementioned displacement of the clamp in an axial direction. According to this document, the lower ends of the clamp are bent in such a way that they form springs with two more or less parallel arms; one of the arms serves as a means of articulating the clamp, whereas the other arm works together with the cams. Such a device produces considerable unattractive bulk at the said bent ends of the clamp; furthermore, the material of which the clamp is made needs to be sufficiently elastic for the spring formed by one bent end to be efficient. The clamp is thus manufactured from a different material to the one used for the cap linked to this clamp.

SUMMARY OF THE INVENTION

The aim of the invention is, especially, to supply a device fitted with a closing device of the type defined previously, which is of robust, economical and simple design. Furthermore, we wish to produce a design in which the co-operation of the clamp and the cam would dispense with the need for an elastic device.

In accordance with the invention, a dispensing device, for a receptacle containing a product of liquid to pasty consistency, of the type defined previously, and which includes a cam device between the arms of the clamp and a fixed part of the receptacle, designed to cause, from commencement of rotation of the cam, from the closed position, the aforementioned displacement of the clamp in an axial direction, is characterized by the fact that the means of articulating the clamp include, for each arm, a non-circular transversal section axis designed to work together with a window in such a way that, whatever the angle of the axis, sufficiently close contact will be established between the axis and the internal surface of the window in order to prevent the clamp from banging against the receptacle, whilst causing the aforementioned displacement in an axial direction.

To its advantage, the window is not circular.

Preferably, the axis should be located on the internal face of each arm of the clamp, whereas the window should be located on a fixed section of the recipient.

The transversal section of the axis may be of any of the following forms: oval, triangular, square, cross-shaped.

In the case of an axis with a cross-shaped transversal section, the window on the fixed part of the receptacle should generally be circular, but its middle section should bear a depression and a boss diametrically opposite each other, corresponding to the closed position of the clamp.

To its advantage, the dispensing device has a clicking ratchet device, which allows for the clamp to be closed or opened, the passage from one position to the other necessitating a degree of force such that it will not be closed or opened accidentally.

The receptacle may be closed using a picot system fixed to the crosspiece of the clamp; the axis is composed of a component, at the base of which there are two shoulders which form an angle together, the upper section of which is a trapezoid with rounded edges the large base of which faces upwards, whereas one contour of the lower section of the window is more or less semi-circular the upper section being triangular, the base of the window including a boss intended to work with the shoulders when the component rotates, this component possessing an axis engaged in a longitudinal slit in the fixed section of the receptacle.

Preferably, the wall of the triangular shaped section of the window should be fairly thin in such a way as to withstand slight distortion during rotation of the component fixed to the clamp.

Advantageously, a boss has been included in the lower section of the window, it being wide enough to allow a definite stopping of the clamp in co-operation due to the walls of the window and the two shoulders.

The dispensing opening in the device may be composed of a slit in a dome shaped membrane located at one end of the receptacle, against which will lie, the aforementioned clamp crosspiece, in the closed position, the cam devices possessing at least one ramp fixed to one of the two elements constituted by the clamp and receptacle, and a follow up ramp component on the other element, in order to cause axial displacement of the clamp at the commencement of rotation.

Preferably, the ramp should be composed of a groove in the receptacle and should have a circle shaped form, the centre of which is in the middle plane of the receptacle, and symmetrical to this plane, the middle of this groove should have an inverted groove, whereas the cam follower component should be composed of a tappet on the lower face of the arm of the adjacent clamp and set into this groove.

BRIEF DESCRIPTION OF THE DRAWINGS

The invention consists, apart from the above, of a number of other arrangements which will be described in more detail below with reference to the diagrams contained in the appendices, but which should not be considered as limitating.

FIG. 2 shows, like FIG. 1, the dispensing device but with the clamp in the open position.

Finally

DETAILED DESCRIPTION OF THE INVENTION

Figure 1:
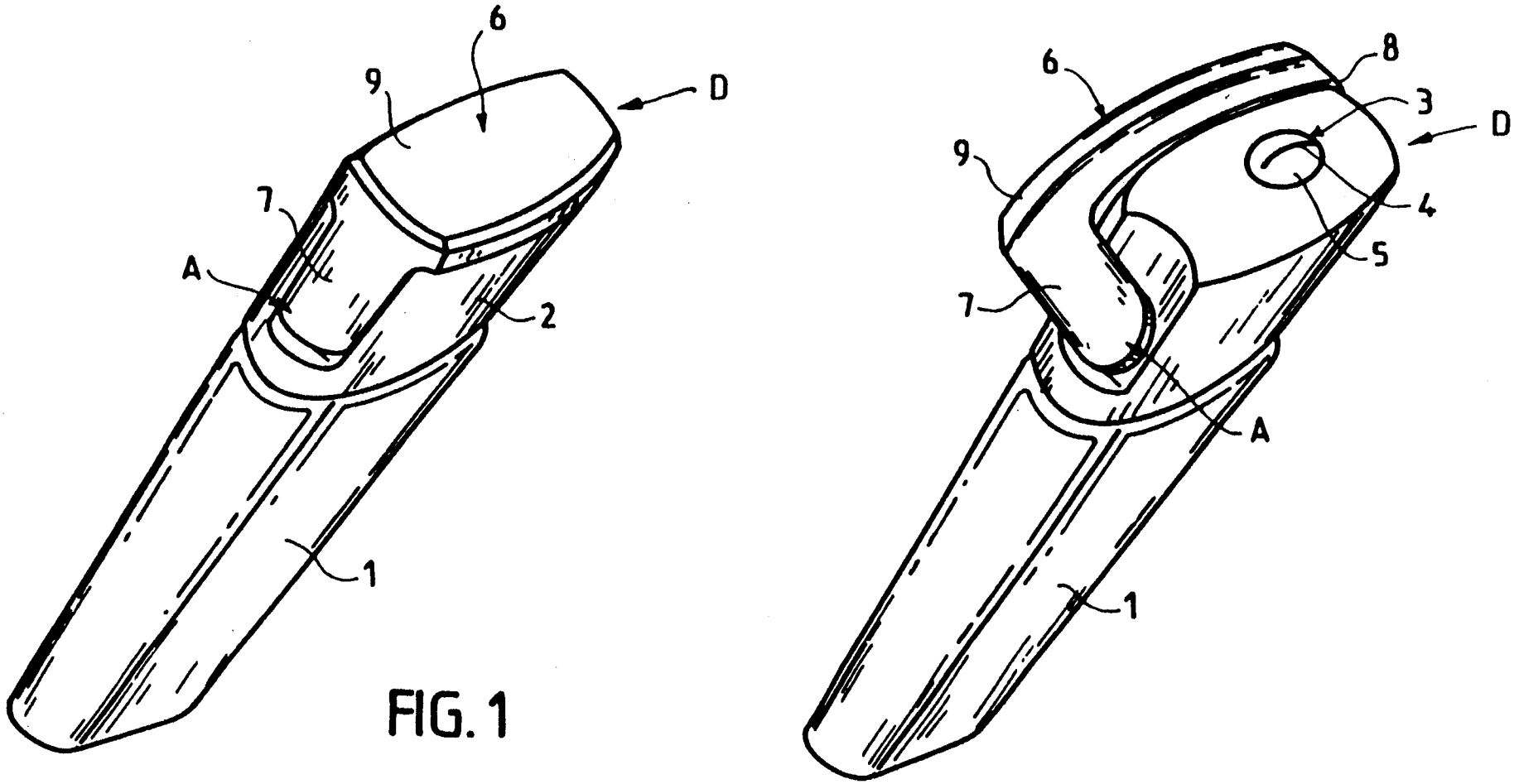
FIG. 1 of these diagrams, shows a perspective of a receptacle fittted with a dispensing device made in accordance with the invention, the clamp of the sealed capsule being in the closed position.

Reference to the diagrams, and notably to FIGS. 1 and 2, will reveal a tube shaped receptacle 1 the transversal section of which is more or less rectangular, the small sides of which are slightly convex at the edges. The larger faces of the receptacle 1 present a certain degree of pliability in that it is possible for the user to distort them by applying pressure. This receptacle 1, of the distortable tube type, is intended to contain a product of liquid to pasty consistency, such as cosmetic cream. The upper end of the receptacle is fitted with a sealing capsule 2 which includes a dispensing opening 3 composed of a slit 4 in a dome shaped membrane 5, as shown in the examples in FIGS. 1 to 5. The capsule 2 is fixed to the neck of the receptacle 1. It is evident that the transversal section of the receptacle may differ from the one shown. It may, for example, be oval or circular.

The dispensing device D, formed by the capsule 2, with the membrane 5 and the dispensing opening 3, includes a means of closing composed of a clamp 6 which has two arms 7, 8 which are more or less parallel, linked to a crosspiece 9, the central zone of which, in the closed position of the clamp 6 as shown in FIG. 1, rests against the membrane 5 and closes the opening 3. In this closed position, the clamp 6 prevents the lips of the slit 4 from opening and prevents dispensing of the product. On the other hand, when the clamp 6 is in the open position shown in FIG. 2, it is possible to obtain the product from the opening 3 by exerting pressure on the large faces of the receptacle 1.

The ends of the arms 7, 8 furthest away from the crosspiece 9 are fitted with means of articulation A designed to allow displacement of the clamp 6 following the axial direction X—X (see FIG. 4) of the receptacle 1 in order to distance the crosspiece 9 from the opening 3. Rotation of the clamp 6, effected by the means of articulation A ensures displacement of the crosspiece 9 following a path more or less at a tangent to the opening 3.

Figure 3:
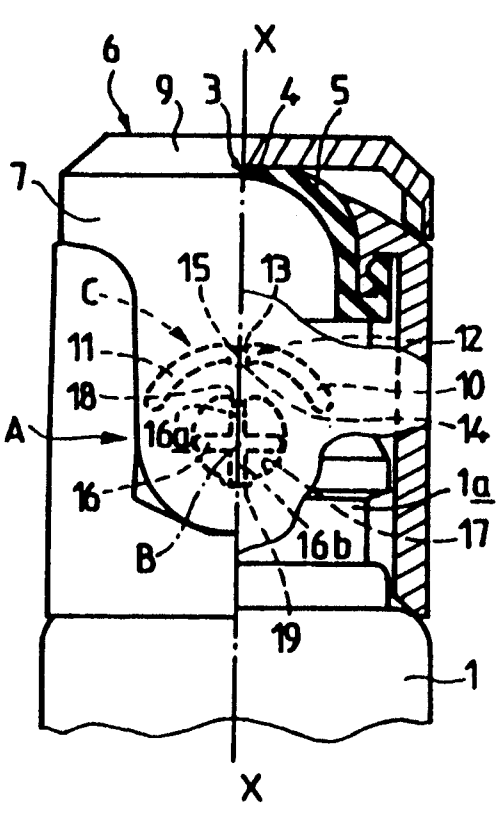
FIG. 3 shows a side view on a larger scale, with certain sections removed or cut out, of the receptacle fitted with the sealed capsule with the clamp in the closed position.

A cam system C is included between arms 7 and 8 of the clamp and a section of the capsule 2 fixed to the receptacle in order to cause, at commencement of rotation of the clamp 6, from its closed position as shown in FIG. 3, the aforementioned displacement of the clamp 6 following the axial direction X—X. Thus, the crosspiece 9 distances itself slightly from the membrane 5 and the opening 3, and any friction between the crosspiece 9 and the membrane 5 is avoided during eventual movement of the clamp 6.

The cam system C comprises, on a part fixed to the receptacle 1, in two zones opposite with respect to the axis X—X, a ramp 10, which in the example considered is composed of a groove 11. The groove 11 is in the form of a circle centred on a geometrical axis B located in the area of the means of articulation A. The groove 11 is located above the means of articulation A, its concave section facing towards the bottom. The middle plane of the groove 11 admits a plane passing through the axis X—X of the receptacle and through the rotation axis B, the middle of said groove having a zone 12 with an inverted curve. This zone 12 is formed between a rounded boss 13 on the upper wall of the groove 11 protruding radially towards the interior by means of a convex surface, and a concave zone 14, located on the lower wall of the groove 11.

Flush with each arm 7, 8 of the clamp, the cam system C includes a cam follower composed of a tappet 15 located on the internal face of each arm. This tappet 15 has a circular section and a diameter equal to the constant width of the groove 11. The tappet 15 is engaged in the corresponding groove 11. In the closed position of the clamp 6, shown in FIG. 3, the tappet 15 works together with the summit of the convex boss 13 and the base of the concave zone 14 in such a way that the clamp 6 is pushed to the bottom to the maximum extent possible. The crosspiece 9, as can be seen on FIG. 3, comes into contact with the membrane 5, and, due to this contact, prevents the slit 4 from opening.

The means of articulation A have been designed to prevent any unexpected movement between the clamp 6 and the receptacle 1, but whilst still authorising the aforementioned displacement following the direction X—X of the clamp 6 at the commencement of rotation.

These means of articulation A include, on each arm 7, 8, an axis 16 located on the internal face of the arm and protruding orthogonally at the middle plane of the arm. This axis 16 has a non-circular transversal section; in the example shown in FIGS. 3 to 5, the axis 16 has a cross-shaped section, with equal length arms, at right angles. The axis 16 is designed, on each side of the neck 1*a* of the receptacle, to work together with a non-circular window 17 located on a fixed part of the receptacle 1, in such a way that whatever the angle of the axis 16, sufficiently close contact will be made between the axis 16 and the internal surface of the window 17 in order to avoid any unexpected movement. The window 17 will generally be circular but the upper section of it will be fitted with a boss 18 which will protrude radially towards the inside, and the lower section of it will bear a hollow 19 diametrically opposite to the boss. The hollow 19 and the boss 18 are located on the middle longitudinal plane of the receptacle and are in line with the inverted curve 12 of the groove 11. Two diametrically opposed arms 16*a*, 16*b* of the axis 16 are in line with the tappet 15, the other two arms of the axis being at right angles.

The co-operation of the arms of the axis 16, aligned with the tappet 15, with the boss 18 and the hollow 19, constitutes a latching mechanism which allows for the clamp 6 to be positioned either in an open or closed position, the passage from one position to the other necessitating such force that it will not be effected accidentally.

It is clear that the axis 16 could have a transversal section of a different form, for example, oval, triangular or square, the form of the window 17 being adapted accordingly. Furthermore, the positions of the window and of the axis could be inverted; the window would thus be located on a branch of the clamp and the axis would be on the fixed part of the receptacle.

Figure 4:
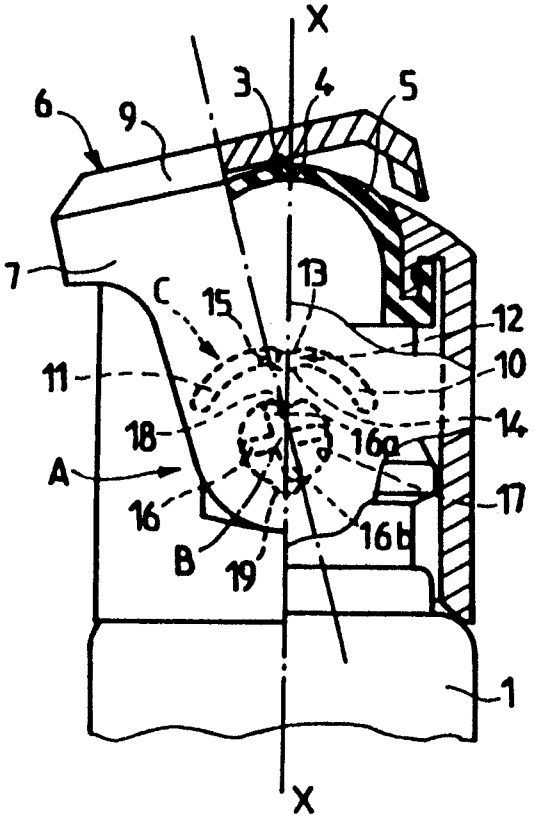
FIG. 4, like FIG. 3, shows the dispensing device at the commencement of rotation of the clamp.

This being the case, it would function as follows:

In the closed position, as shown in FIG. 3, the clamp 6 is applied against the opening 3, as has already been explained, due to the position of the clamp 15 in the hollow of zone 12. When the user effects the rotation movement of the clamp 6, whatever the direction of rotation, the clamp 6 will be lifted by one of the sloping surfaces leading down to the base of the concave section 14. This will cause displacement of the arms 7, 8 and of the crosspiece 9 following a direction corresponding more or less to the axis X—X. The crosspiece 9 is distanced from the membrane 5 following a direction perpendicular to the surface with which it is in contact. At the commencement of this rotation movement, the two arms 16*a*, 16*b* of the axis 16 aligned with the clamp 6 release themselves respectively from the hollow 19 and the boss 18 as shown in FIG. 4. The axis 16 remains in contact at at least three points with the wall of the window 17, which prevents any unexpected movement.

Figure 5:
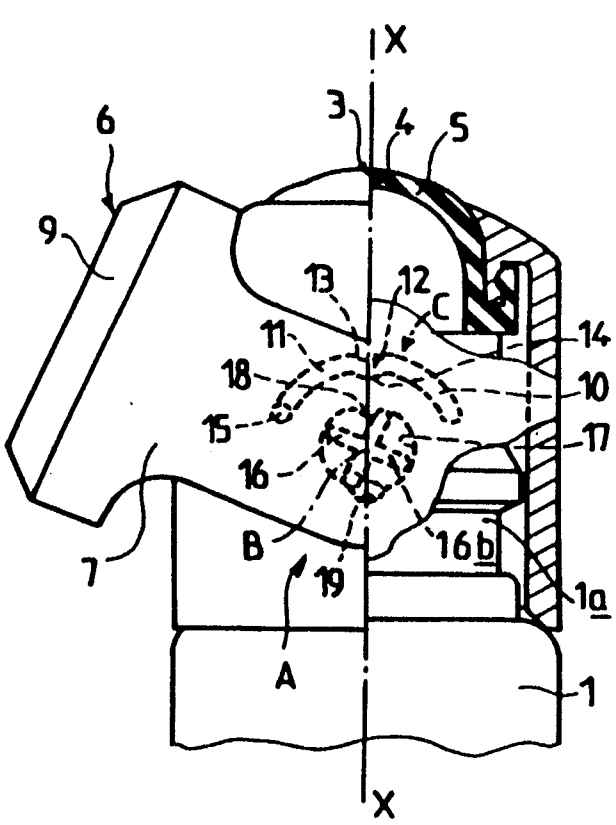
FIG. 5, like FIG. 3, shows the device with the clamp in the open position.

The follow through of the rotation movement of the clamp 6 may continue until the clamp 6 arrives at the end of the groove 11, as shown in FIG. 5.

Figure 6:
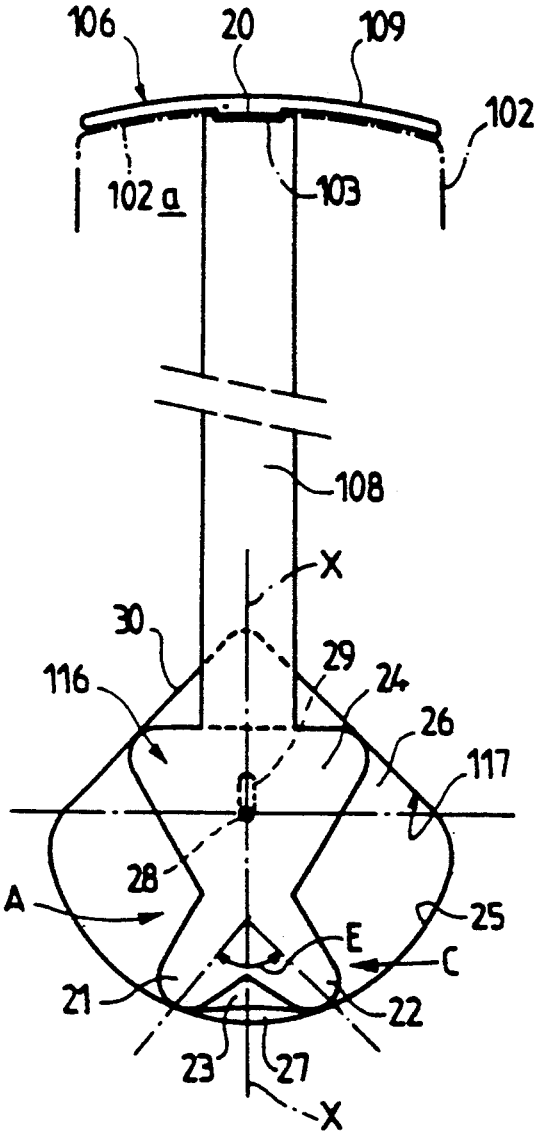
FIG. 6 is a schematic side view showing another example of a means of articulation of a clamp, including a crosspiece fitted with a picot which goes into the dispensing opening, the whole being shown in the closed position.
Figure 7:
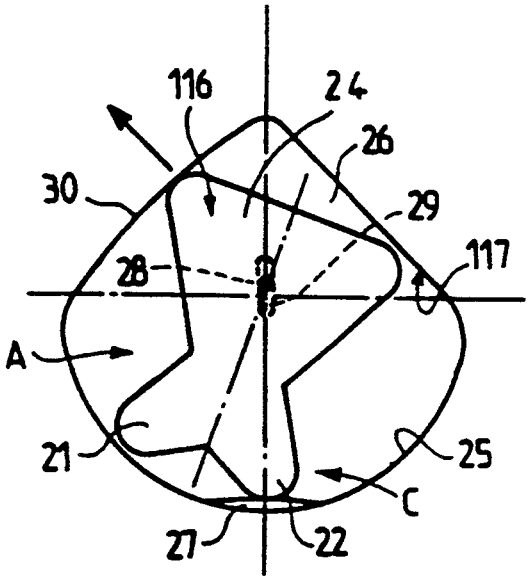
FIG. 7 is a view of part of the articulation shown in FIG. 6 at the commencement of rotation of the clamp.
Figure 8:
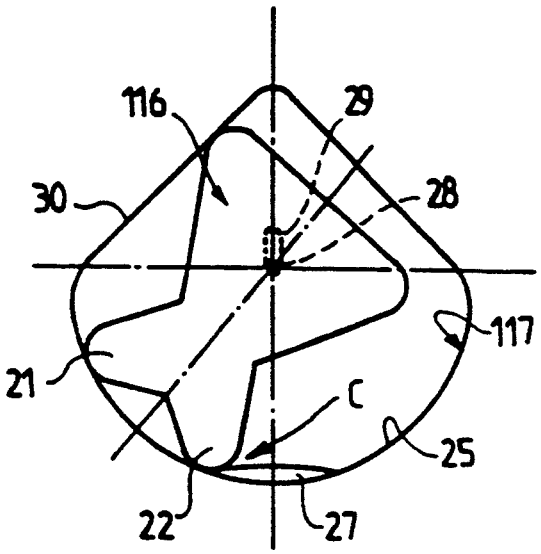
FIG. 8 shows the articulation represented in FIG. 6 with the clamp in the open position.

Reference to FIGS. 6 to 8 will reveal a variation in the dispensing device: only the upper part of the capsule 102 is shown in the diagram, the dispensing opening 103 being composed of a hollow section set into the top of the capsule. Closing of this hollow section 103 is effected by the entrance of a picot 20 formed on the internal face of the crosspiece 109 of the clamp 106. This picot 20 seals the opening 103 when the clamp 106 is in the closed position. The crosspiece 109 is interdependent with the two arms, in the manner described above, but only one arm 108 is represented in FIG. 6. The means of articulation A, located on the lower part of the arm 108, include a component 116 protruding towards the interior, supported by the end of each arm 108. The component 116 which extends in an orthogonal direction to the plane of the arm 108, is set in an opening or window 117 set into a fixed part of the receptacle not shown in FIG. 6.

The component 116 is of prismatic form, a section of which may be seen in FIG. 6, the generators of the prism being orthogonal to the plane of FIG. 6. The base of the component 116 has two shoulders 21, 22 which are symmetrical in relation to the direction of the middle longitudinal arm 108. The middle lines of the shoulders 21, 22 together form an angle E of approximately 90°. A concave section of a free space 23, formed by the lower surfaces of the shoulders 21, 22, in the form of a dihedron, faces the bottom.

The upper zone of the component 116, situated above the shoulders 21, 22, presents a more or less isosceles shaped trapezoid transversal section, the large base of which faces upwards and the small base of which is located at the link point of the upper and lower parts formed by the shoulders. The angles of the part 24 situated at the ends of the large base are rounded off.

The window 117, associated with the component 116 is set into the fixed part of the receptacle, the component 116 being set into this window. The contour 25 of the lower part of the window 117 is more or less semicircular, whereas the upper part 26 of this window is in the form of an isosceles triangle. In the closed position, the clamp 106, the rounded ends of the shoulders 21, 22, lean against the contour 25, whereas the rounded ends of the large base of the part 24 lean against the sides of the angle forming the upper part 26.

The base of the window 117, that is to say the lower area of the contour 25, includes a boss 27 intended to work together with the shoulders, the top of this boss being formed by a slightly convex surface.

The component 116 includes an axis 28 which protrudes transversally towards the interior, that is to say on the side of the wall of the receptacle, this axis 28 being more or less in the centre of gravity of the part 24 and extending perpendicularly across the plane of FIG. 6. The axis 28 is composed of a tappet or a circular section slug.

An elongated slit 29, the large axis of which merges with a symmetrical axis of the window 117, is set into the fixed part of the receptacle which bears this window 117, to take the axis 28. This slit 29 is designed in such a way that when the clamp 106 is in a closed position, as shown in FIG. 6, the axis 28 is adjacent to or in contact with the lower end of the slit 29. The slit is sufficiently long to allow displacement of the axis 28 during opening. The width of the window 29 is equal to the diameter of the axis 28 in such a way as to assist in holding the component 116 in a lateral position.

The upper part 26 of the wall 30 of the window 117 is relatively thin in order that it may be distorted slightly, as shown in FIG. 7, when the component 116 is being rotated.

Given this, the dispensing device functions as follows:

When the user pivots the clamp 106, for example in a clockwise direction, the shoulder 22 working together with the boss 27, as shown in FIG. 7, initiates an axial movement of the clamp 106 and of the crosspiece 109, the picot of which frees itself from the opening 103. The axis 28 moves towards the top of the slit 29 as shown in FIG. 7.

The rotation of the clamp 106 may follow and the crosspiece 109 will describe a more or less circular trajectory, the axis 28 remaining at the same level in the slit 29 during this movement, whereas the end of the shoulder 22 moves against the upper convex zone of the boss 27. During this rotation of the component 116, the rounded angle of the upper part 24, opposite the boss 27, is in contact with the wall 30, which undergoes slight elastic deformation as shown in FIG. 7. This elastic deformation contributes, during closure of the capsule, good return of the clamp 106 to the neutral position, thanks to pressure exerted by the wall 30 against the component 116.

At the end of the opening action of the clamp 106, the shoulder 22, as shown in FIG. 8 comes into contact with the far lefthand end of the boss 27, whereas the shoulder 21 is in contact with the contour 25 and the rounded angle opposite the shoulder 22 is in contact with the wall 30. The axis 28 will again be in contact with the lower end of the slit 29. The width of the boss 27 thus allows a definite stopping of the clamp 106 and of the crosspiece 109. To its advantage, the whole is designed in such a way that the clamp 106 will be locked into an open position such that the upper part 109 of the clamp forms a continuous section with the fixed dome 102*a* of the capsule 102.

It would seem that the component 116 cannot unexpectedly move about inside the window 117 during the movement of the clamp 106, thanks to the various contacts effected between the shoulder 22 and the rounded angle opposite, and thanks to the axis 28 engaged in the slit 29.

We claim:

1. Dispensing device, for a receptacle containing a product of liquid to pasty consistency, including a sealing capsule fitted with a dispensing opening, the said capsule including a means of closing which is in the form of a clamp with two arms linked by a crosspiece, said crosspiece having one area which serves to close the said opening, the ends of the said arms away from the crosspiece having means of articulation on a section fixed to the receptacle, said means of articulation allowing displacement of the clamp along the axial direction of the receptacle in order to distance the crosspiece from the said opening, wherein rotation of the clamp will cause displacement of the crosspiece at a tangent to the said opening, said dispensing device including a cam system, located between the arms of the clamp and a fixed part of the receptacle causing, from commencement of rotation of the cam from the closed position, the aforementioned displacement of the clamp along said axial direction, wherein the means of articulation (A) of the clamp include, for each arm, a non-circular axis (16, 116) cooperating with a window (17, 117) having an internal surface engaged by said axis in such a way that, whatever the angle of the axis, the contact between the axis (16, 116) and the internal surface of the window (17, 117) will be sufficiently close to avoid any unexpected movement of the clamp in relation to the receptacle, whilst initiating the aforementioned displacement along the axial direction.

2. Dispensing device in accordance with claim 1, characterized by the fact that the window (17, 117) is non-circular.

3. Dispensing device in accordance with claim 1 or 2, characterized by the fact that the axis (16, 116) is located on the internal face of each arm (7, 8, 108) of the clamp, whereas the window (17, 117) is located on a fixed part of the receptacle.

4. Dispensing device in accordance with claim 3, characterized by the fact that the axis (16) is selected from the group consisting of oval, trangular, square or cross-shaped.

5. Dispensing device in accordance with claim 1, characterized by the fact that it includes a latching mechanism (16, 18, 19, 21, 22, 27) allowing the clamp (6, 106) to be positioned either in an open or closed position, the passage from one position to the other necessitating such force that intentional actuation is required.

6. Dispensing device in accordance with claim 1 in which the dispensing opening (3) is composed of a slit (4) in a dome shaped membrane (5) located at one end of the receptacle, the aforementioned clamp crosspiece (9) coming into contact with the membrane in the closed position, characterized by the fact that the cam system (C) include at least one ramp (10) fixed to one of the two elements constituted by the clamp (6) and the receptacle (1) and a ramp component follower (15) set into the other element in order to cause axial displacement of the clamp (6) at commencement of the rotation movement.

7. A dispensing device for a receptacle containing a product of liquid to pasty consistency, including a sealing capsule fitted with a dispensing opening, said capsule including a means of closing which is in the form of a clamp having two arms linked by a crosspiece, said crosspiece having one area which serves to close the said opening, the ends of said arms farthest away from the crosspiece having means of articulation on a section fixed to said receptacle, said means of articulation allowing displacement of said clamp along the axial direction of said receptacle in order to distance the crosspiece from said opening, wherein rotation of the clamp will cause displacement of the crosspiece at a tangent to the said opening, said device including a cam system, located between the arms of the clamp and a part of the receptacle causing, from commencement of rotation of the cam from the closed position, said displacement of the clamp along said axial direction, wherein the means of articulation of the clamp include, for each arm, a non-circular axis cooperating with a window having an internal surface engaged by said axis in such a way that, whatever the angle of the axis, the contact between the axis and said internal surface of the window will be sufficiently close to avoid any sudden movement of the clamp in relation to said receptacle, while initiating the aforementioned displacement along said axial direction, said receptacle being closed by a picot system fixed to said crosspiece of said clamp, wherein said axis includes a component having a base having two shoulders which together form an angle, said component having an upper part presenting a trapezoid with rounded angles, said trapezoid having a large base which faces upwardly, said window having a lower section which is substantially semi-circular and an upper part which is triangular, said window having a base including a boss for cooperation with said shoulders during rotation of said component, said component having an axis engaged in a longitudinal slit provided in a portion of said receptacle.

8. Dispensing device in accordance with claim 1, characterized by the fact that the wall (30) of the triangular section (26) of the window is fairly thin in order to withstand slight distortion during rotation of the component (116) fixed to the clamp (106).

9. Dispensing device in accordance with claim 7 or 8, characterized by the fact that the boss (27), provided at the lower section of the window (117), is wide enough in order to produce definite stopping of the clamp due to cooperation between the walls (25) of the window and the two shoulders (21, 22).

10. A dispensing device for a receptacle containing a product of liquid to pasty consistency, including a sealing capsule fitted with a dispensing opening, said capsule including a means of closing which is in the form of a clamp having two arms linked by a crosspiece, said crosspiece having one area which serves to close the said opening, the ends of said arms farthest away from the crosspiece having means of articulation on a section fixed to said receptacle, said means of articulation allowing displacement of said clamp along the axial direction of said receptacle in order to distance the crosspiece from said opening, wherein rotation of the clamp will cause displacement of the crosspiece at a tangent to the said opening, said device including a cam system, located between the arms of the clamp and a part of the receptacle causing, from commencement of rotation of the cam from the closed position, said displacement of the clamp along said axial direction, wherein the means of articulation of the clamp include, for each arm, a non-circular axis cooperating with a window having an internal surface engaged by said axis in such a way that, whatever the angle of the axis, the contact between the axis and said internal surface of the window will be sufficiently close to avoid any sudden movement of the clamp in relation to said receptacle, while initiating the aforementioned displacement along said axial direction, said non-circular axis being located on the internal face of each said arm of said clamp, said window being located on a part of said receptacle, said window being circular and located in a middle plane Of said receptacle and including a hollow and a boss diametrically opposite said hollow and corresponding to the closed position of said clamp.

11. A dispensing device for a receptacle containing a product of liquid to pasty consistency, including a sealing capsule fitted with a dispensing opening, said capsule including a means of closing which is in the form of a clamp having two arms linked by a crosspiece, said crosspiece having one area which serves to close the said opening, the ends of said arms farthest away from the crosspiece having means of articulation on a portion of said receptacle, said means of articulation allowing displacement of said clamp along the axial direction of said receptacle in order to distance the crosspiece from said opening, wherein rotation of the clamp will cause displacement of the crosspiece-at a tangent to the said opening, said device including a cam system, located between the arms of the clamp and a part of the receptacle causing, from commencement of rotation of the cam from the closed position, the aforementioned displacement of the clamp along said axial direction, wherein the means of articulation of the clamp include, for each arm, a non-circular axis cooperating with a window having an internal surface engaged by said axis in such a way that, whatever the angle of the non-circular axis , the contact between the non-circular axis and the internal surface of the window will be sufficiently close to avoid any sudden movement of the clamp in relation to said receptacle, while initiating the aforementioned displacement along the axial direction, said dispensing opening comprising a slit formed in a dome shaped membrane located at one end of said receptacle, said crosspiece being dimensioned to come into contact with said membrane when in a closed position, said cam system including at least one ramp fixed to a part of one of said clamp and said receptacle and a ramp follower being associated with the other of said clamp and said receptacle to cause axial displacement upon commencement of rotational movement of said clamp, said ramp including a groove set into said receptacle, said groove being arc shaped and convexly curved relative to said opening of said receptacle, said receptacle having a middle plane with said groove being located in said middle plane, at least one of said arms of said clamp including an internal face confronting said receptacle and a cam follower comprising a tappet disposed on said internal face and engaged in said groove.

* * * * *